US006788623B2

(12) United States Patent
Hiranuma et al.

(10) Patent No.: US 6,788,623 B2
(45) Date of Patent: Sep. 7, 2004

(54) WRIST WATCH

(75) Inventors: Haruki Hiranuma, Chiba (JP); Isao Ajiro, Chiba (JP); Nobukazu Oomori, Chiba (JP)

(73) Assignee: Seiko Instruments Inc., Chiba (JP)

( * ) Notice: Subject to any disclaimer, the term of this patent is extended or adjusted under 35 U.S.C. 154(b) by 128 days.

(21) Appl. No.: 09/997,815

(22) Filed: Nov. 30, 2001

(65) Prior Publication Data

US 2002/0080688 A1 Jun. 27, 2002

(30) Foreign Application Priority Data

Dec. 21, 2000 (JP) ..... 2000-389110

(51) Int. Cl.[7] ..... G04B 37/00

(52) U.S. Cl. ..... 368/88; 368/281; 368/291; 368/294; 368/309

(58) Field of Search ..... 368/88, 276, 281, 368/286–287, 291–294, 296, 297, 298, 299, 300, 309

(56) References Cited

U.S. PATENT DOCUMENTS

| | | | | | |
|---|---|---|---|---|---|
| 3,640,065 | A | * | 2/1972 | Lederrey et al. | 58/90 R |
| 3,729,924 | A | * | 5/1973 | Aoki | 58/90 R |
| 4,034,552 | A | * | 7/1977 | Davidson | 58/88 R |
| 4,281,406 | A | * | 7/1981 | Tanaka | 368/82 |
| 4,544,284 | A | * | 10/1985 | Geiger et al. | 368/294 |
| 4,696,577 | A | * | 9/1987 | Muller et al. | 368/276 |
| 5,825,722 | A | * | 10/1998 | Meyrat et al. | 368/276 |
| 6,406,178 | B1 | * | 6/2002 | Luscher et al. | 368/286 |

* cited by examiner

*Primary Examiner*—Vit W. Miska
(74) *Attorney, Agent, or Firm*—Adams & Wilks

(57) ABSTRACT

To provide a wrist watch having a small rim width while ensuring the strength of a glass rim. A movement with hands and a dial plate is assembled into a barrel from a side of a glass rim. A water-proof packing is arranged between a glass rim and the barrel. Machine screws are mounted inside the water-proof packing to fix the barrel and the glass rim together.

17 Claims, 6 Drawing Sheets

WRIST WATCH

BACKGROUND OF THE INVENTION

1. Field of the Invention

The invention relates to a wrist watch having a glass rim.

2. Description of the Prior Art

It has been a general practice in conventional wrist watches having a movement inserted within a glass rim for fixing the glass rim by means of machine screws.

FIG. 3 is a view illustrating the construction of a conventional wrist watch in which a glass rim is fixed by means of machine screws. In the conventional wrist watch, a female thread portion 21*a* is provided on an outer periphery of a waterproof packing 40 interposed between a glass rim 21 and a barrel 31. Accordingly, the distance from the outer diameter D1 of the dial plate to the outer diameter of the glass rim 21 is the sum of a dial plate bearing surface width A, a width D of a wall to which the waterproof packing 40 is mounted, a width B of a box for the waterproof packing 40, a wall thickness C of the box, a dimension E of the female thread portion, and a width F of bearing surfaces of the glass rim 21 and the barrel 31, that is, (A+D+B+C+E+F).

FIG. 6 is a cross sectional view showing a construction for fixation of a chamfer-type glass rim in a conventional wrist watch. A glass rim 22 has a chamfer portion 22*a* with an interference between it and a barrel 32, and is fixed to the barrel 32 by the interference. Accordingly, stress at the time of mounting is applied to fixed portions of the glass rim 22 and a glass 70 to make the same susceptible of deformation, so that the adhesive structure of the glass 70 to the glass rim 22 cannot be used due to deterioration in adhesive quality and so the glass 70 is fixed to the glass rim 22 through a plastic packing 70*a* having a chamfer. Also, since the glass rim 22 and the barrel 32 are fixed to each other by means of the chamfer portion 22*a*, they are restricted to a round configuration in plan, and are used under such design restrictions that in view of maintenance of the quality of fixing of the glass rim 22, the glass rim 22 is formed from a material except a precious metal or increased as a whole in wall thickness.

Conventional wrist watches have a problem in that since machine screws are arranged on an outer periphery of a waterproof packing in order to maintain the barrel of the watch casing and the glass rim waterproof, a width from an external shape of a glass portion of the glass rim to an external shape of the glass rim is enlarged, and thus it is difficult to make the glass rim thin. Therefore, although a certain design quality is demanded, it has been difficult under considerable design restrictions to obtain a desired design.

Also, wrist watches, in which a glass rim is fixed by mounting a portion of the glass rim directly to a barrel of a watch casing with a chamfer, cause a problem that in order to maintain the quality of opening and closing the glass rim, the glass rim is required to have a width and thickness for ensuring the strength of a glass rim material. Further, with wristwatches intended for accessories and ornaments, a precious metal material is frequently used to make a glass rim but a usable material is limited due to the material strength and dimensional restrictions, thus causing a problem that a material is restricted. Therefore, for preservation of strength, the glass rim must be made considerable in thickness and width, so that it is not possible to make the glass rim thin and to make a thin-type wrist watch, which is wanted by users, and development of design quality is sought after with difficulty.

Under these circumstances, with a chamfer-type glass rim, stress at the time of mounting possibly leads to coming-off of an adhesive portion in quality in the case where a glass is fixed to the glass rim by an adhesive, so that such way of fixation is less implemented and is made little use of. Also, at the time of maintenance of a movement with hands and a dial plate, opening and closing of the glass rim entails degradation in quality of mounting, and so the way of fixation is not accepted in the market.

SUMMARY OF THE INVENTION

Thereupon, the invention has been devised in view of the above, and has its object to provide a wrist watch, in which a glass rim is reduced in width and in thickness, restrictions on materials for the glass rim are relaxed, and a glass rim of a high design quality having a demand in the market is fixed.

The invention provides a wrist watch comprising a glass rim for fixation of a glass, a barrel which contacts with an underside of the glass rim to contain therein a movement, a first packing provided between the glass rim and the barrel to ensure a waterproof seal between the glass rim and the barrel, and screws disposed inside of the packing to fix the barrel and the glass rim together.

The screws are disposed inside of the first packing so that it is possible to provide a glass rim of a small diameter while ensuring a waterproof seal.

Also, according to the invention, the screws have a second packing in an optional position on an external shape thereof.

The second packing is provided on the screws to enable providing a glass rim of a small diameter.

Also, with the wrist watch according to the invention, the barrel has screw recesses, into which the screws are inserted, and the second packings and the screw recesses engage with each other.

The screw hole and the second packing engage with each other to thereby enable ensuring water-proofness on the screw hole.

Further, with the wrist watch, the glass rim comprises a dial-plate bearing surface, which bears a dial-plate, a female thread portion adapted to engage with the screws, a packing box, which bears the first packing, and a bearing surface, which bears the barrel.

Thereby, it is possible to reduce a width of the glass rim.

Also, in the construction composed of a glass rim, a barrel and a back cover, the screws not only latch the glass rim but also may be used for fixation of the back cover as well as latching of the glass rim.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

The invention will be described below in detail with reference to the drawings. In addition, the invention is not limited to the disclosed embodiments.

Figure 1:
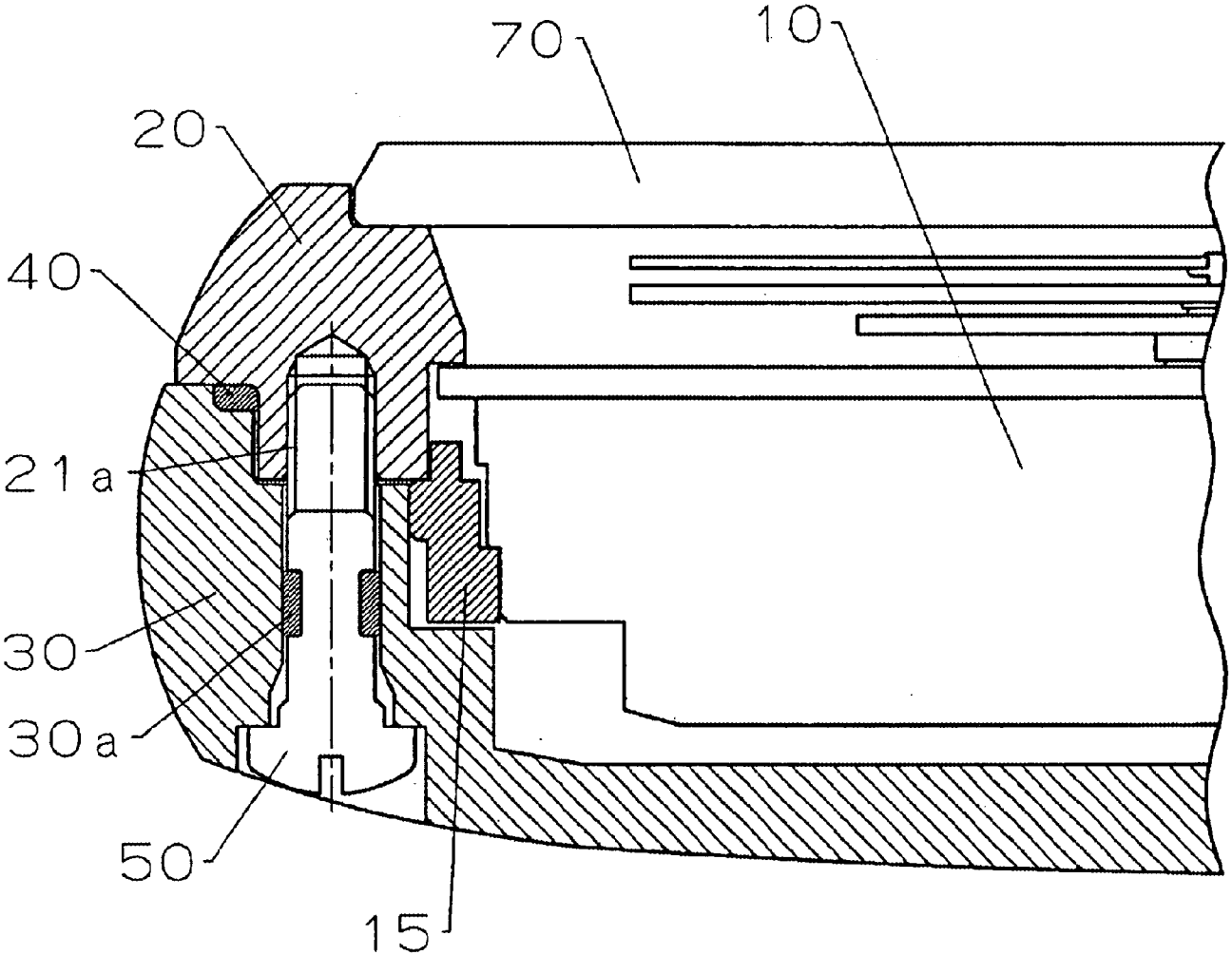
FIG. 1 is a cross sectional view showing a wrist watch according to an embodiment of the invention.

FIG. 1 is a cross sectional view showing a wrist watch as assembled according to an embodiment of the invention. A movement 10 with hands and a dial plate is assembled into a barrel 30 from a side of a glass rim 20 with a movement holding member such as an inner frame 15, and a packing 40 intended for water-proofness between the glass rim 20 and the barrel 30 is wound around a wall of an outer periphery of a female thread portion 21*a* provided on the glass rim 20 to engage with a packing box of the barrel 30 and machine screws 50 cause the packing 40 to be engaged by the female thread portion 21*a*, which is provided on the glass rim 20, from a back side of the barrel 30 with the barrel 30 therebetween to be fixed.

Figure 2:
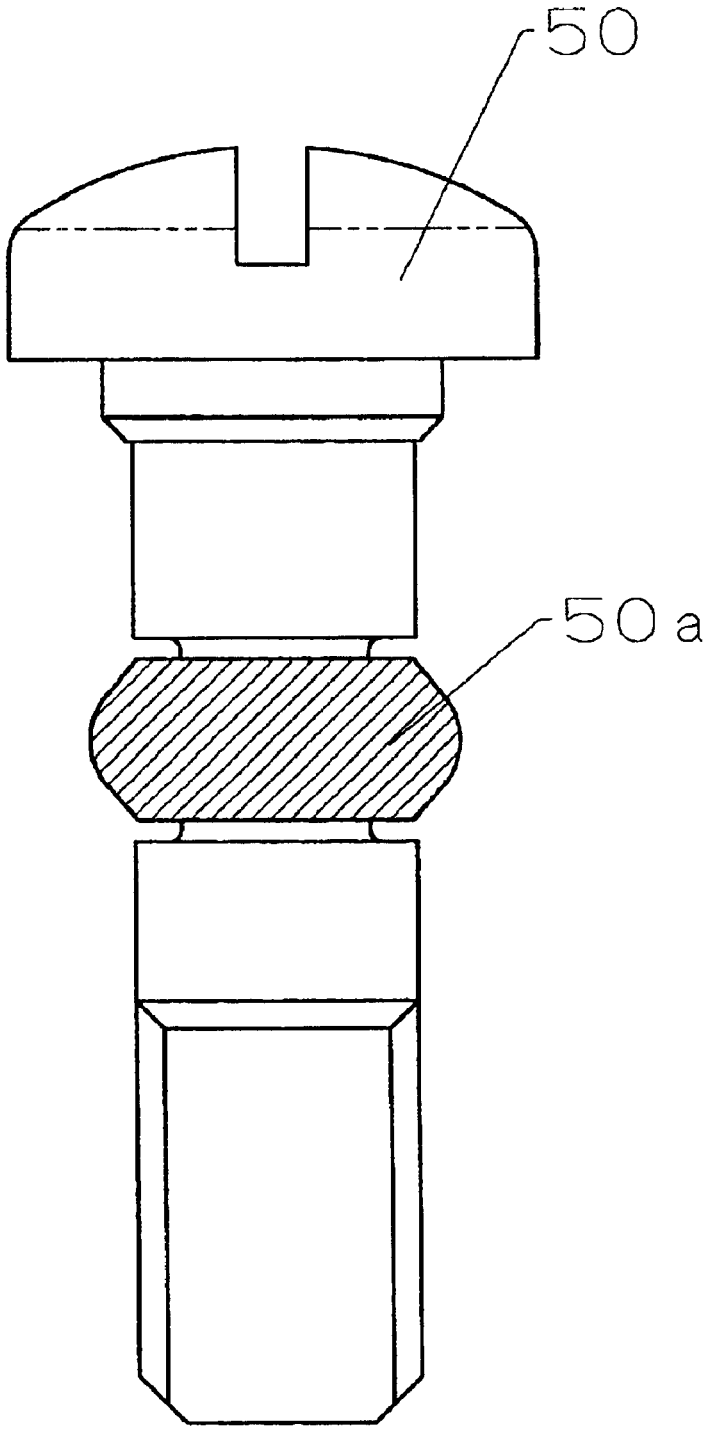
FIG. 2 is a side view showing a machine screw for fixation of a glass rim in a wrist watch according to an embodiment of the invention.
Figure 3:
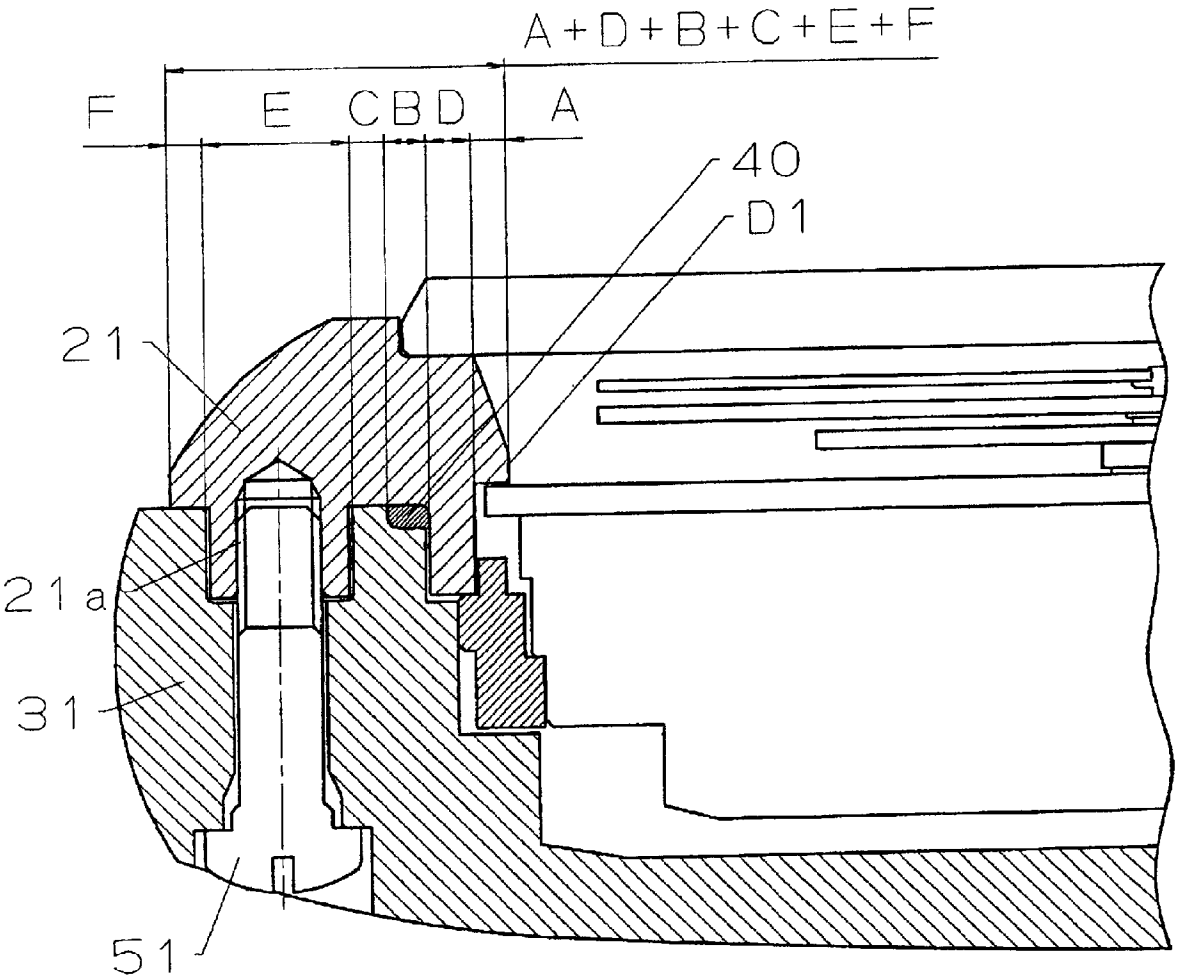
Prior Art FIG. 3
FIG. 3 is a view illustrating a conventional construction for mounting of a glass rim.

FIG. 2 is a side view showing a machine screw 50 for fixation of the glass rim 20. The male screw 50 has a packing 50*a* adapted to engage in an optional position between a male screw recess 30*a* provided in the barrel 30 and the male screw, the packing having an interference for water-proofness.

Hereafter, the construction of fixing the glass rim 20 in such a wrist watch will be described in order.

Figure 4:
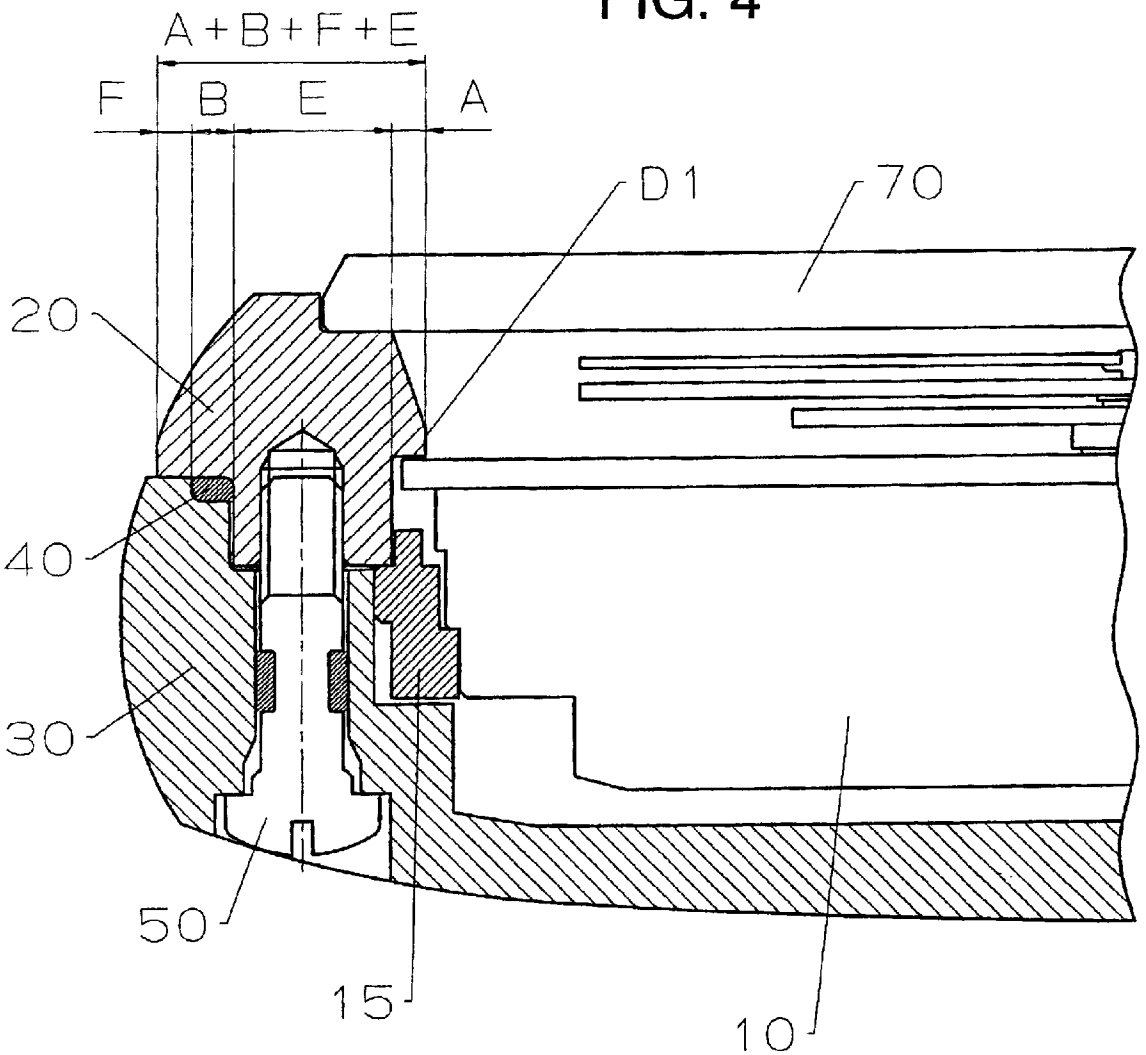
FIG. 4 is a view illustrating the construction for mounting of a glass rim according to an embodiment of the invention.

FIG. 4 is a view illustrating the construction of a wrist watch according to the invention. The view is a cross sectional view representing the construction from an outer diameter of a dial plate D1 to an external surface of the glass rim 20. The distance from a dial plate outer diameter D1 to the glass rim 20 is (A+E+B+F), wherein a dial-plate bearing surface width is A, a dimension of the female thread portion is E, a width of a box for the waterproof packing 40 is B, and a width of bearing surfaces of the glass rim 20 and the barrel 30 is F.

Accordingly, unlike a conventional wrist watch, the sum of a width D of a wall, to which the waterproof packing 40 is mounted, and a thickness C of a wall constituting a configuration of the box, that is, (D+C) is not necessary, so that it is possible to reduce an edge width of the glass rim 20 by (D+C). Generally, the width D of a wall, to which the waterproof packing 40 is mounted, can be reduced by from around 0.5 mm to 0.6 mm, and the thickness C of a wall constituting a configuration of the box can be reduced by from around 0.3 mm to 0.6 mm. Accordingly, (D+C) is decreased by from around 0.8 mm to 1.1 mm on one side. The entire external shape can be decreased by 1.6 mm to 2.2 mm, a value, which is twice the above value, on both sides.

Figure 5:
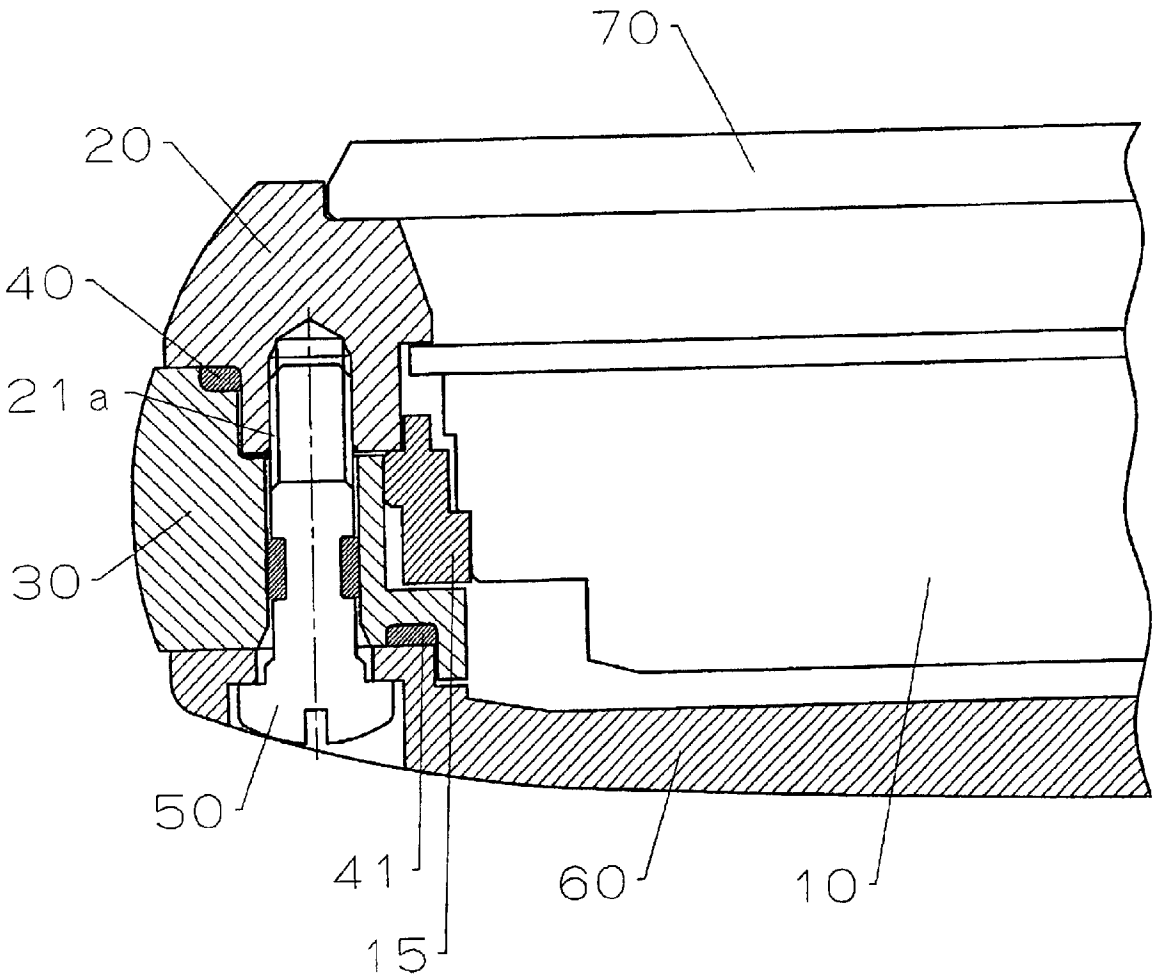
FIG. 5 is a cross sectional view showing another example of a construction, in which a glass rim is mounted, according to an embodiment of the invention.
Figure 6:
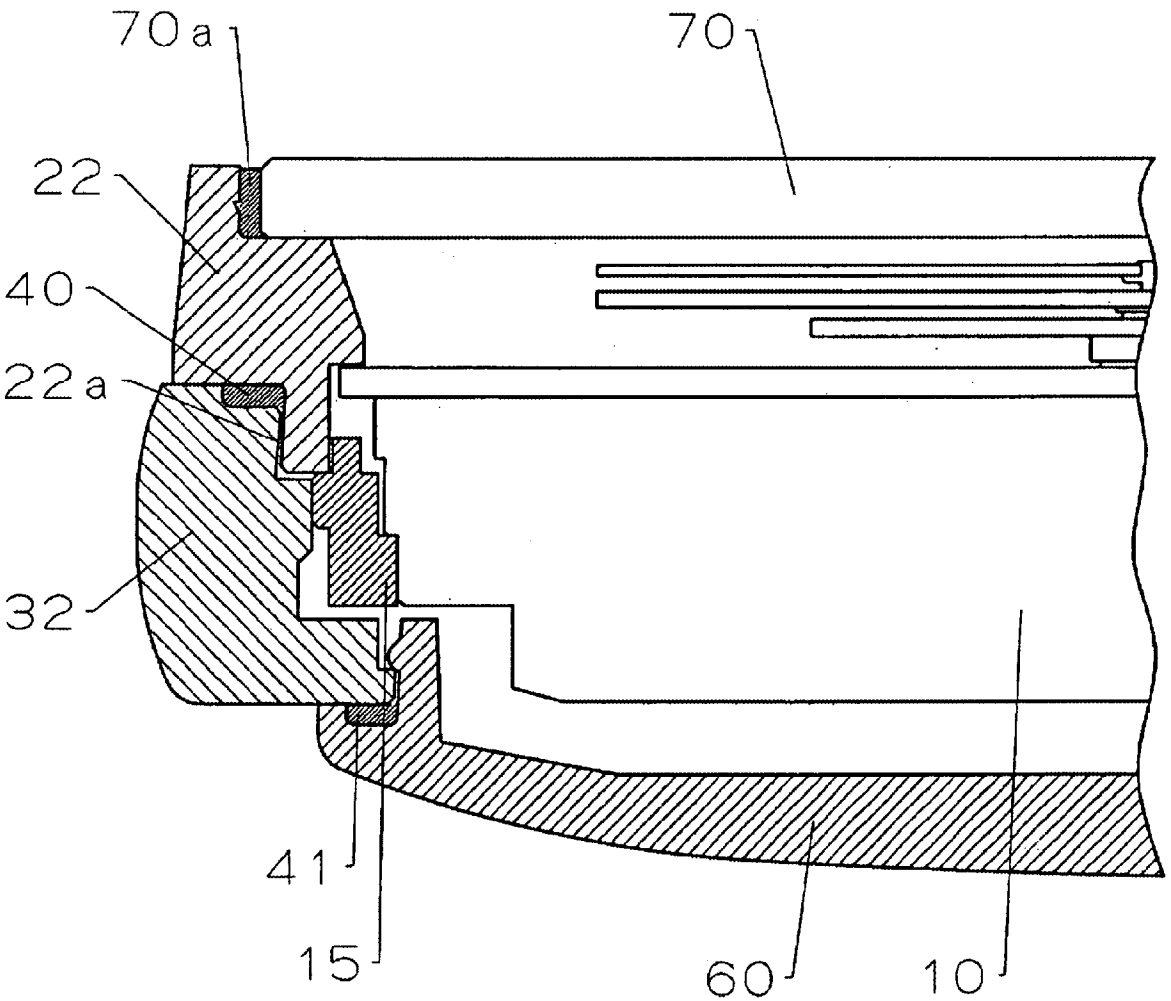
PRIOR ART FIG. 6
FIG. 6 is a cross sectional view showing another example of a construction for mounting of a glass rim in a conventional configuration.

FIG. 5 is a cross sectional view showing another example 1 of a construction, in which a glass rim is mounted, according to an embodiment of the invention. A glass rim 20 of a wrist watch according to the another example 1 is fixed by fixing a movement 10 with hands and a dial plate into a barrel 30 through an inner frame 15 from a direction, in which the glass rim 20 is assembled into the barrel 30, assembling the glass rim in a state, in which a water-proof packing 40 is wound around an outer wall of a female thread portion 21*a* of the glass rim 20, and turning machine screws 50 provided with a packing 50*a* and intended for maintaining water-proofness between the screw and a male screw recess 30*a*, through a back cover 60 provided for easiness of maintenance and an increase in variations of external appearance and arranged on a back surface side of the barrel 30.

Also, water-proofness between the barrel 30 and the back cover 60 is maintained by a water-proof packing disposed inside of the machine screws 50 provided with the packing and assembled on a side of the barrel 30.

As described above, since it is possible in a wrist watch of the invention to readily reduce a width of a glass rim as compared with a conventional construction, it is possible to enlarge a display portion of a dial plate by such reduction and to improve visibility of the display portion. Also, since the glass rim is fixed by machine screws, it is possible to use a material of relatively low strength such as precious metals for the glass rim. Since there is no configurational restriction in terms of construction as exemplified by circular and varied configurations in plan, there can be obtained an effect that wrist watches of different designs suited to a user's taste can be readily presented by gathering designs for the glass rim in abundance.

What is claimed is:

1. A wristwatch case comprising: a rim member for supporting a watch glass; a barrel supporting the rim member by contacting an underside of the rim member and containing therein a movement and a display driven by the movement for displaying current time, the display being viewable through the watch glass; a first packing provided between the rim member and the barrel to maintain a waterproof seal between the rim member and the barrel; and screws disposed within an inner diameter of the first packing to fix the barrel and the rim member together; wherein a distance from an outer diameter of the display to an outer diameter of the rim member is substantially equal to (A+B+E+F), wherein A is a width of a display bearing surface of the rim member in contact with the display, B is a width of a recess in which the first packing is inserted, E is a width of a screw hole in which a respective screw is inserted, and F is a width of bearing surfaces of the rim member and the barrel in contact with each other.

2. A wristwatch case according to claim 1; wherein the screws have a second packing provided on an external surface thereof.

3. A wristwatch case according to claim 1; wherein screw holes are formed in the barrel and the rim member for receiving the screws, the screws have a second packing provided on an external surface thereof, and the screw holes and the second packings engage each other to maintain a waterproof seal.

4. A wristwatch case according to claim 2; wherein screw holes are formed in the barrel and the rim member for receiving the screws, and the screw holes and the second packings engage each other to maintain a waterproof seal.

5. A wrist watch case according to claim 1; wherein the display has a dial plate covering the movement and indicating members movable relative to the dial plate to indicate time, the display bearing surface of the rim member comprises a dial plate bearing surface for supporting the dial plate, the rim member has female thread portions formed therein for engaging the screws, and the recess is formed in the rim member for receiving the first packing.

6. A wristwatch case according to claim 2; wherein the display has a dial plate covering the movement and indicating members movable relative to the dial plate to indicate time, the display bearing surface of the rim member comprises a dial plate bearing surface for supporting the dial plate, the rim member has female thread portions formed therein for engaging the screws, and the recess is formed in the rim member for receiving the first packing.

7. A wristwatch case according to claim 3; wherein the display has a dial plate covering the movement and indicating members movable relative to the dial plate to indicate time the display bearing surface of the rim member comprises a dial plate bearing surface for supporting the dial plate, the screw holes include female thread portions formed in the rim member for engaging the screws, and the recess is formed in the rim member for receiving the first packing.

8. A wristwatch case comprising: a first case member for housing a movement and a display; a second case member for supporting a watch glass through which the display is viewable; a first packing provided between the first case member and the second case member to maintain a waterproof seal therebetween; and screws disposed within an inner diameter of the first packing to fix the first and second case members together; wherein a distance from an outer diameter of the display to an outer diameter of the second case member is substantially equal to (A+B+E+F), wherein A is a width of a display bearing surface of the second case member in contact with the display, B is a width of a recess in which the first packing is inserted, E is a width of a screw hole in which a respective screw is inserted, and F is a width of bearing surfaces of the first and second case members in contact with each other.

9. A wristwatch case according to claim 8; wherein the screws have a second packing provided on an external surface thereof.

10. A wristwatch case according to claim 9; wherein screw holes are formed in the first and second case members for receiving the screws, and the screw holes and the second packings engage each other to maintain a waterproof seal.

11. A wristwatch case according to claim 8; wherein the display has a dial plate covering the movement and indicating members movable relative to the dial plate to indicate time, the display bearing surface of the second case member comprises a dial plate bearing surface for supporting the dial plate, female thread portions are formed in the second case member for engaging the screws, and the recess is formed in the second case member for receiving the first packing.

12. A wristwatch case comprising: a first case member for housing a movement and a display; a second case member for supporting a watch glass through which the display is viewable; a first packing provided between the first case member and the second case member to maintain a waterproof seal therebetween; and screws disposed within an inner diameter of the first packing to fix the first and second case members together; wherein the display comprises a dial plate covering the movement and indicating members movable relative to the dial plate to indicate time; and the second case member has a dial plate bearing surface for supporting the dial plate, a female thread portion for engaging the screws, a recess for receiving the first packing, and a bearing surface in contact with the first case member.

13. A wristwatch case according to claim 12; wherein the screws have a second packing provided on an external surface thereof.

14. A wristwatch case according to claim 13; wherein screw holes are formed in the first and second case members for receiving the screws, and the screw holes and the second packings engage each other to maintain a waterproof seal.

15. A wristwatch case comprising: a rim member for supporting a watch glass; a barrel supporting the rim member by contacting an underside of the rim member and containing therein a movement and a display driven by the movement for displaying current time, the display being viewable through the watch glass; a first packing provided between the rim member and the barrel to maintain a waterproof seal between the rim member and the barrel; and screws disposed within an inner diameter of the first packing to fix the barrel and the rim member together; wherein the display has a dial plate covering the movement and indicating members movable relative to the dial plate to indicate time; and the rim member has a dial plate bearing surface for supporting the dial plate, a female thread portion for engaging the screws, a recess for receiving the first packing, and a bearing surface in contact with the barrel.

16. A wristwatch case according to claim 15; wherein the screws have a second packing provided on an external surface thereof.

17. A wrist watch case according to claim 15; wherein the barrel and the rim member have screw holes formed therein into which the screws are inserted, the screws have a second packing provided on an external surface thereof, and the screw holes and the second packings engage each other to maintain a waterproof seal.

* * * * *